US006231300B1

(12) United States Patent
Wilhelm et al.

(10) Patent No.: US 6,231,300 B1
(45) Date of Patent: May 15, 2001

(54) PERIPHERAL PUMP

(75) Inventors: Hans-Dieter Wilhelm, Neu-Anspach Bundesrepublik; Christoph Schmidt, Rotenburg; Thomas Werner, Nentershausen, all of (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/171,374

(22) PCT Filed: Apr. 10, 1997

(86) PCT No.: PCT/EP97/01772

§ 371 Date: Mar. 4, 1999

§ 102(e) Date: Mar. 4, 1999

(87) PCT Pub. No.: WO97/40274

PCT Pub. Date: Oct. 30, 1997

(30) Foreign Application Priority Data

Apr. 18, 1996 (DE) ..... 196 15 322

(51) Int. Cl.[7] ..... F04D 5/00

(52) U.S. Cl. ..... 415/55.1; 415/55.5

(58) Field of Search ..... 415/55.1, 55.2, 415/55.3, 55.4, 55.5, 55.6, 55.7

(56) References Cited

U.S. PATENT DOCUMENTS 1,689,579 10/1928 Burks .

2,042,499 6/1936 Brady .

(List continued on next page.)

FOREIGN PATENT DOCUMENTS

| | | |
|---|---|---|
| 3708336 | 9/1988 | (DE) . |
| 8911302 | 3/1991 | (DE) . |
| 4020521 | 1/1992 | (DE) . |
| 19504079 | 8/1996 | (DE) . |
| 9200457 | 1/1992 | (WO) . |

OTHER PUBLICATIONS

E. Tonn, Zur Berechnung von Peripheralpumpen (Design of Peripheral Pump) (pp. 64–70).

*Primary Examiner*—F. Daniel Lopez
*Assistant Examiner*—Richard Woo
(74) *Attorney, Agent, or Firm*—Mayer, Brown & Platt

(57) ABSTRACT

In a peripheral pump, having a rotor (2) which rotates in a pump casing (1) and having two delivery chambers (11, 12), which extend on both sides of the end sides (3, 4) and each have circular cross sections, the delivery chambers (11, 12) have a communicating passage (13) between them, formed by an overlap of their cross sections. As a result, the liquid can flow without interference from one delivery chamber (11) into the other delivery chamber (12). One delivery chamber (11) is connected to an inlet duct, while the other delivery chamber (12) is connected to an outlet duct.

16 Claims, 1 Drawing Sheet

U.S. PATENT DOCUMENTS

| | | | | |
|---|---|---|---|---|
| 2,051,080 | | 8/1936 | Frederick . | |
| 3,133,505 | | 5/1964 | Heerens et al. . | |
| 3,399,626 | | 9/1968 | Skinner . | |
| 3,685,287 | | 8/1972 | Dooley . | |
| 3,951,567 | | 4/1976 | Rohs . | |
| 3,982,848 | | 9/1976 | Schonwald et al. . | |
| 4,325,672 | * | 4/1982 | Sixsmith et al. | 415/55.1 |
| 4,474,534 | | 10/1984 | Thode . | |
| 4,854,830 | | 8/1989 | Kozawa et al. | 415/55.1 |
| 4,872,806 | | 10/1989 | Yamada et al. | 415/55.5 |
| 4,923,365 | * | 5/1990 | Rollwage | 415/55.1 |
| 4,948,344 | | 8/1990 | Cygnor | 415/55.1 |
| 5,080,554 | | 1/1992 | Kamimura | 415/55.6 |
| 5,163,810 | | 11/1992 | Smith | 415/55.1 |
| 5,330,319 | | 7/1994 | Yu et al. | 415/55.1 |
| 5,409,357 | | 4/1995 | Yu et al. | 415/55.1 |
| 5,415,521 | | 5/1995 | Hufnagel et al. | 415/55.1 |
| 5,435,692 | | 7/1995 | Kidger et al. . | |
| 5,558,490 | | 9/1996 | Dobler et al. | 415/55.1 |
| 5,586,858 | | 12/1996 | Tuckey . | |
| 5,680,700 | | 10/1997 | Tuckey . | |
| 5,716,191 | | 2/1998 | Ito et al. | 415/55.1 |
| 5,785,490 | | 7/1998 | Dobler et al. | 415/55.1 |
| 5,807,068 | * | 9/1998 | Dobler et al. | 415/55.1 |
| 5,921,746 | | 7/1999 | Yu et al. | 415/55.1 |
| 5,975,843 | | 11/1999 | Ebihara | 415/55.1 |

* cited by examiner

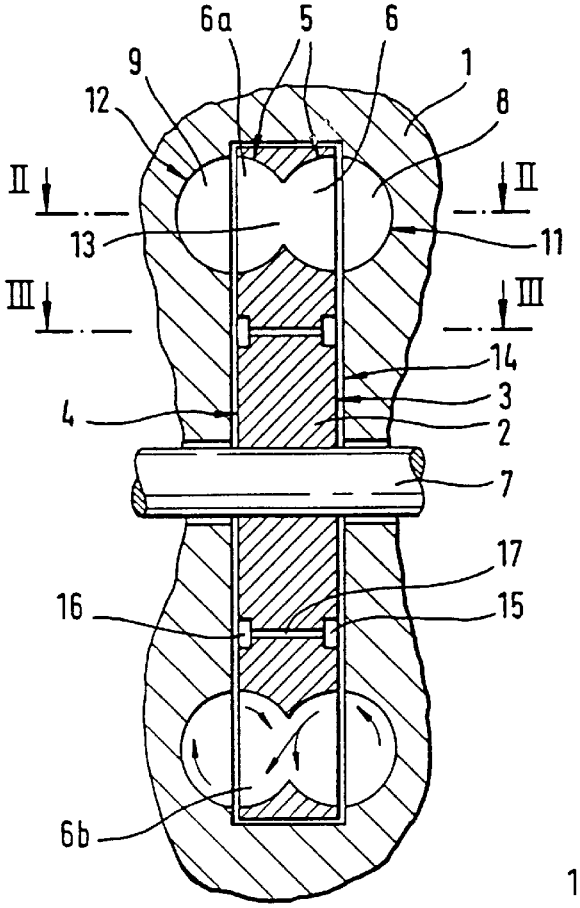
Fig.1
Fig.3
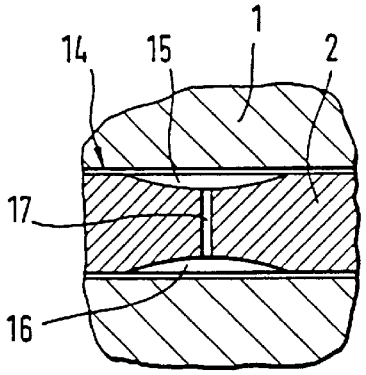
Fig.2
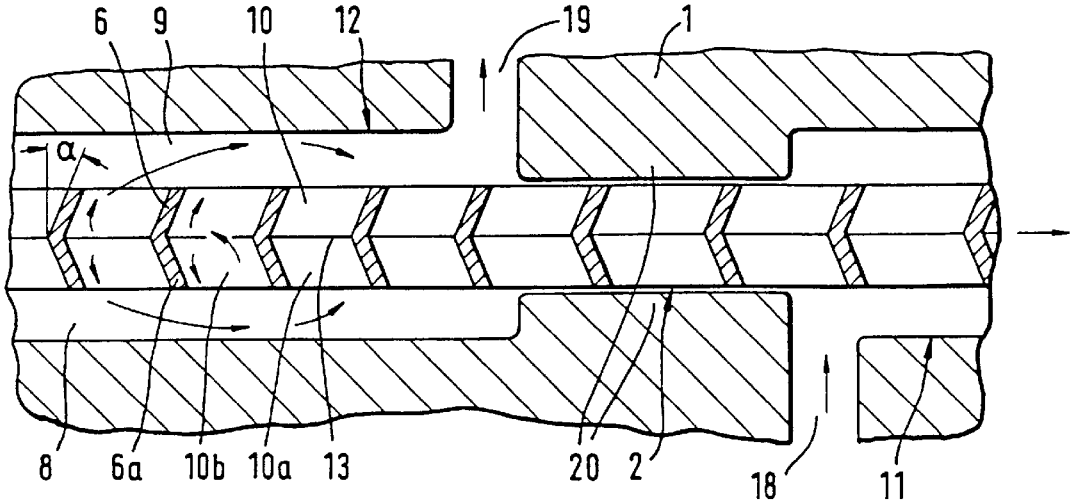

PERIPHERAL PUMP

BACKGROUND OF THE INVENTION

1. Field of the Invention

The invention relates to a peripheral pump having a driven rotor, which rotates in a pump casing and in which a ring of blades is formed in each of its end sides for the purpose of delivering a liquid from an inlet duct to an outlet duct, and having annular ducts, which are formed in the pump casing on both sides in the region of the blades and, together with blade chambers between the blades, form delivery chambers which face one another, the rotor, in its radially inner region and in the region of its circumferential edge, facing toward the pump casing at a slight distance therefrom so as to delimit a sealing gap, and the blades, as seen in the direction of rotation, rising from the central region of the rotor toward the end sides.

2. Background of the Invention

Such peripheral pumps are often used to deliver fuel in a fuel tank of a motor vehicle and are therefore known. In this case, the delivery chambers are separated from one another by a central web arranged in the center of the rotor. When the rotor rotates, the blades generate in the delivery chambers a circulating flow which runs transversely to the direction of movement of the blades. On both sides of the rotor, this circulating flow runs from inlet ducts which are arranged on each side in the pump casing to the outlet ducts. A sill, which interrupts the circulating flows, is arranged in each of the annular ducts of the pump casing, between the outlet ducts and the inlet ducts. This peripheral pump is maintenance-free and has a high level of efficiency. The form of the blades in which they rise from the central region of the rotor toward its end sides reduces impact losses which are caused by the liquid striking the front side or flowing around the blades. These impact losses always occur when the liquid to be delivered passes from the annular ducts into the region of the rotor. Furthermore, this design of the blades accelerates the liquid, when it enters the annular ducts, to a velocity which initially, as seen in the direction of rotation of the rotor, is higher than the velocity of the blades. Then, the velocity decreases in the direction of rotation of the rotor, while the velocity transverse to the direction of rotation increases. Consequently, the circulating flows are in the form of a lance directed in the direction of rotation of the rotor, leading to a high delivery pressure of the peripheral pump.

A drawback of the known peripheral pump is that it has two inlet ducts and two outlet ducts. This desien leads to an unnecessarily high installation outlay on the peripheral pump. Furthermore, owing to its two delivery chambers which are separated from one another by the central web, the peripheral pump has a large structural volume.

Axial flow peripheral pumps having a single outlet duct and a single inlet duct have already been disclosed, in which pumps the liquid flows over from one delivery chamber to the other delivery chamber. In this case, the liquid flows through the rotor in a radially outer region of the blade chambers. However, this design leads to an unfavorable circulating flow profile which has to be diverted by guide elements on the rear sides of the blades. These guide elements are also intended to reduce the impact losses on the inlet side. However, these guide elements cause friction losses and take up a considerable portion of the volume of the delivery chambers. As a result, the peripheral pump has a lower delivery volume and a lower delivery pressure compared to other peripheral pumps.

SUMMARY OF THE INVENTION

The invention is based on the problem of designing a peripheral pump of the type mentioned at the outset in such a way that it has a structural volume which is as small as possible while simultaneously exhibiting a high delivery volume and a high delivery pressure.

Pumps are also known in which the liquid flows over through an aperture between two adjacent delivery chambers (WO-A-92/90457, U.S. Pat. No. 5,409,537). The drawback of these pumps consists in the fact that this flowing over interferes with the circulating flow in the delivery chambers, and as a result the delivery volume and the delivery pressure are reduced.

According to the invention, this problem is solved by the fact that in the region of two mutually facing blade chambers of the blades there is a communicating passage for the liquid to flow over, and that the inlet duct is connected to one delivery chamber and the outlet duct is connected to the other delivery chamber.

Owing to this design, flow passes through the peripheral pump axially via a first delivery chamber and a second delivery chamber, and the pump has in each case only a single inlet duct and a single outlet duct. The peripheral pump can therefore be fitted, for example in a fuel tank, with particularly little outlay. The rotor does not have a central web dividing the delivery chambers from one another, so that the peripheral pump is of particularly narrow design. The peripheral pump according to the invention has a particularly high delivery volume, since the blade chambers are not constricted by guide elements. Owing to the communicating passage between its delivery chambers, the friction losses within the circulating flow during a transition from the first delivery chamber into the second delivery chamber are kept particularly low. Thus the liquid can flow, virtually without interfering with the circulating flow, from the first delivery chamber into the second delivery chamber, leading to a particularly high delivery pressure and to a particularly high efficiency of the peripheral pump according to the invention. The low level of interference with the circulating flow has an advantageous effect particularly for hot liquids with a high vapor pressure, since in the event of the circulating flow being interfered with or broken up, they tend to form vapor bubbles which reduce the delivery pressure and cause cavitation damage to the rotor. Furthermore, owing to the low friction losses, the liquid to be delivered is scarcely heated.

If the delivery chambers have a circular cross section in the region of the blade chambers, the friction losses are particularly low.

The impact losses when the circulating flow enters the blade chambers can be limited to a minimum if, according to another advantageous refinement of the invention, the blades, as seen in the direction in which the rotor moves, rise, by an angle of 5 to 45° with respect to the line perpendicular to the surfaces of the end sides of the rotor, from the central region of the rotor toward the respective end side.

Even at a low speed of the rotor, the peripheral pump according to the invention achieves a particularly high delivery pressure if, according to another advantageous refinement of the invention, the blades, as seen in the direction in which the rotor moves, rise, by an angle of 10 to 20° with respect to the line perpendicular to the surfaces of the end sides of the rotor, from the central region of the rotor toward the respective end side.

At low speeds, it is very easy to produce a lance-like circulating flow which is directed in the direction of rotation of the rotor if, in accordance with another advantageous refinement of the invention, the blades, as seen in the direction in which the rotor moves, rise in the form of a parabola from the central region of the rotor toward the end sides.

Resonant vibrations which occur at specific speeds of the peripheral pump and viscosities of the liquids and lead to disturbing noises, can easily be avoided, according to another advantageous refinement of the invention, by positioning the blades at different angular spacings with respect to one another.

A small structural depth and easy manufacture are provided if the communicating passage is formed by an overlap between the circular delivery chambers.

The liquid flows particularly easily from the first delivery chamber into the second delivery chamber if the communicating passage produced by the overlap of the delivery chambers, according to another advantageous refinement of the invention, is widened outward and/or inward in the radial direction of the rotor. This additionally leads to an increase in the maximum delivery pressure which can be achieved.

The ratio between the velocity of the liquid perpendicular to the direction of rotation and the average velocity in the direction of rotation is decisive for the stability of the circulating flow and hence for the maximum delivery pressure which can be produced using the peripheral pump. At a predetermined operating point of a peripheral pump, at which the circular delivery chambers are divided approximately half and half between the blade chambers and the annular ducts, this ratio is dependent only on the ratio of the average diameter of the ring of blades to the radius of the delivery chambers. In the case of such a peripheral pump, according to another advantageous refinement of the invention a high delivery pressure is easy to achieve by selecting the ratio of the average diameter of the ring of blades to the radius of the delivery chamber to be greater than 7 and less than 99.

Tests have led to a particularly high delivery pressure if the ratio of the average diameter of the ring of blades to the radius of the delivery chamber, according to another advantageous refinement of the invention, is selected to be greater than 15 and less than 30.

According to another advantageous refinement of the invention, disturbances caused by the circulating flow breaking off after leaving the blade chambers are easily avoided in that those edges of the blades which project into the delivery chambers are rounded or have a bevel.

The radius or the bevel on the blades only has to be present on the edges at which the circulating flow comes into contact with the blades. In this case, the blades are of particularly simple design if the radius or the bevel, as seen in the direction in which the rotor moves, is arranged in a radially outer region on the edge of the front side of the blades and in a radially inner region on the edge of the rear side.

The disturbance-inhibiting action of the radii or of the width of the bevels depends essentially on the dimensions of the blades. Thus, for example, large blades require correspondingly large radii or bevels. According to another advantageous refinement of the invention, the liquid circulates with particularly little disturbance in the delivery chambers if the radius or the width of the bevel corresponds to at least 1/70 of the height of the blades.

Axial forces acting on the rotor could press the rotor against the pump casing during operation of the peripheral pump, which would lead to increased wear while simultaneously reducing the delivery pressure. According to another advantageous refinement of the invention, the axial forces acting on the rotor can be absorbed easily if the rotor, on its end sides, has a plurality of recesses which lie opposite one another and in each case two mutually opposite recesses are connected to one another. As a result, the recesses form pressure pockets of an axial sliding-contact bearing, which are connected to the delivery chambers via the sealing gaps between the rotor and the pump casing. Leakage of the liquid to be delivered through the sealing gap causes liquid to pass into the recesses, so that the rotor floats on a film of liquid when rotating. As a result, these sliding-contact bearings prevent the rotor from coming into contact with the pump casing during operation of the peripheral pump according to the invention.

The recesses could be arranged in a radially outer region of the rotor, as seen from the blades. In this region, the rotor has a high peripheral velocity, with the result that the axial forces are absorbed even when starting up the peripheral pump. However, the peripheral pump is of particularly space-saving design if, according to another advantageous refinement of the invention, the recesses, as seen from the blades, are arranged in the radially inner region of the rotor.

Owing to their high volume, the recesses exhibit extremely good emergency running properties in the event of a brief absence of liquid to be delivered if, according to another advantageous refinement of the invention, the recesses are of trough-like design.

According to another advantageous refinement of the invention, the recesses are easy to produce if, in a tangential section through the rotor, they are of pocket-shaped design.

The rotor is inexpensive to produce if, according to another advantageous refinement of the invention, it is produced from plastic using the injection-molding process. Furthermore, the rotor made from plastic has a particularly low weight, with the result that the peripheral pump reaches its maximum delivery capacity very quickly after being started up.

BRIEF DESCRIPTION OF THE DRAWINGS

The invention allows numerous embodiments. To further clarify its basic principle, one of these is described below and illustrated in the drawing, in which:

FIG. 1 shows a longitudinal section through a peripheral pump according to the invention, FIG. 2 shows a tangential section through the peripheral pump shown in FIG. 1, on line II—II, FIG. 3 shows a tangential section through the peripheral pump shown in FIG. 1, on line III—III.

DETAILED DESCRIPTION OF THE PREFERRED EMBODIMENTS

FIG. 1 shows a longitudinal section through a peripheral pump according to the invention, having a pump casing 1 in which a rotor 2 is rotatably arranged. A ring 5 of blades 6, 6*a*, 6*b* is formed in each of the two end sides 3, 4 of the rotor 2. In its center, the rotor 2 is attached in a rotationally fixed manner to a drive shaft 7. In the region of the blades 6, 6*a*, 6*b*, the pump casing 1 has an annular duct 8, 9 on both sides. Together with blade chambers 10, 10*a*, 10*b*, which are illustrated in FIG. 2, between the blades 6, 6*a*, 6*b*, the annular ducts 8, 9 form delivery chambers 11, 12 which each have a circular cross section. In the event of rotation of the rotor 2, circulating flows of a liquid which is to be delivered are formed in the delivery chambers 11, 12. For clarification purposes, the circulating flows are indicated by arrows in FIGS. 1 and 2. In this case, the delivery chambers 11, 12 are each divided half and half between the blade chambers 10, 10*a*, 10*b* and the annular ducts 8, 9 and have a communicating passage 13 between them, which is produced by an overlap of their circular cross sections. Owing to this communicating passage 13, liquid can flow virtually without turbulence from one delivery chamber 11 into the other delivery chamber 12.

In its radially outer region and on its end sides 3, 4, the rotor 2 lies opposite the pump casing 1 at a small distance therefrom. As a result, a sealing gap 14 is formed which runs around the rotor 2 and seals the delivery chambers 11, 12.

In the radially inner region of the rotor 2, as seen from the blades 6, 6*a*, 6*b*, a plurality of mutually opposite recesses 15, 16 are formed in the end sides 3, 4. In each case two mutually opposite recesses 15, 16 are connected to one another by means of a passage 17. A small quantity of leaked liquid to be delivered passes into the recesses 15, 16 through the sealing gap 14 between the rotor 2 and the pump casing 1. As a result, the recesses 15, 16 form axial sliding-contact bearings for the rotor 2. During operation of the peripheral pump, the rotor 2 therefore floats without friction on a film of liquid.

FIG. 2 shows a tangential section through the peripheral pump according to the invention which is shown in FIG. 1, on line II—II. In order to clarify the drawing, the delivery chambers 11, 12 and the rotor 2 are drawn flat in the region of the blades 6, 6*a*, 6*b*. The pump casing 1 has an inlet duct 18 and an outlet duct 19, which are separated from one another by a sill 20 which is arranged on both sides of the rotor 2. The sill 20 interrupts the circulating flows of the liquid to be delivered which are formed in the delivery chambers 11, 12. The inlet duct 18 is connected to the first delivery chamber 11 directly behind the sill 20. The second delivery chamber 12 opens out into the outlet duct 19 directly in front of the sill 20, as seen in the direction of rotation.

The blades 6, 6*a*, 6*b* are arranged symmetrically in the rotor 2 and rise by an angle $\alpha$ from an axially central region of the rotor 2 toward the end sides 3, 4 of the rotor 2. In this example, the angle $\alpha$ which is illustrated is about 15°. This configuration accelerates the flow of the liquid on entering the annular ducts 8, 9 in the circumferential direction to a velocity which is initially greater than the velocity of the blades 6. Then, the velocity of the liquid in the circumferential direction decreases, while the velocity transverse to the rotor 2 increases. As a result, a lance-like flow profile of the circulating flow is formed in each of the annular ducts 8, 9, with the result that a high maximum delivery pressure can be generated.

FIG. 3 shows a tangential section through the recesses 15, 16 of the rotor 2, on line III—III in FIG. 1. The recesses 15, 16 are made in the form of pockets in the rotor 2 and are connected to one another in their center by means of the passage 17.

What is claimed is:

1. A peripheral pump having a driven rotor (2), which rotates in a pump casing (1) and in which a ring (5) of blades (6) is formed in each of its end sides (3, 4) for the purpose of delivering a liquid from an inlet duct (18) to an outlet duct (19), and having annular ducts (8, 9) having semicircular cross sections, which are formed in the pump casing (1) on both sides in the region of the blades (6) and, together with blade chambers (10, 10*a*) between the blades (6), form delivery chambers (11, 12) which face one another, the rotor (2), in its radially inner region and in the region of its circumferential edge, facing toward the pump casing (1) at a distance therefrom so as to delimit a sealing gap (14), and the blades (6), as seen in the direction of rotation, rising from the central region of the rotor toward the end sides (3, 4), wherein, in the region of two mutually facing blade chambers (10, 10*a*) of the blades (6) a communicating passage (13) is formed for the liquid to flow over, the inlet duct (18) being connected to one delivery chamber (11) and the outlet duct (19) being connected to the other delivery chamber (12), wherein the delivery chambers (11, 12) have a semicircular cross section in the region of the blade chambers (10, 10*a*), and wherein the communicating passage (13) has a contour defined by an overlap of the circular cross sections of the delivery chambers (11, 12).

2. The peripheral pump as claimed in claim 1, wherein the blades (6), as seen in the direction in which the rotor (2) moves, rise, by an angle of 5 to 45° with respect to the line perpendicular to the surfaces of the end sides (3, 4) of the rotor (2), from the central region of the rotor (2) toward the respective end side (3, 4).

3. The peripheral pump as claimed in claim 2, wherein the blades (6), as seen in the direction in which the rotor (2) moves, rise, by an angle of 10 to 20° with respect to the line perpendicular to the surfaces of the end sides (3, 4) of the rotor (2), from the central region of the rotor (2) toward the respective end side (3, 4).

4. The peripheral pump as claimed in claim 1, wherein the blades (6), as seen in the direction in which the rotor (2) moves, rise in the form of a parabola from the central region of the rotor (2) toward the end sides (3, 4).

5. The peripheral pump as claimed in claim 1, wherein the blades (6) are at different angular spacings with respect to one another.

6. The peripheral pump as claimed in claim 1, wherein the communicating passage (13) produced by the overlap of the delivery chambers (11, 12) is widened outward and/or inward in the radial direction of the rotor (2).

7. The peripheral pump as claimed in claim 1, in which the circular delivery chambers are divided approximately half and half between the blade chambers and the annular ducts, wherein the ratio of the average diameter of the ring (5) of blades (6) to the radius of the delivery chambers (11, 12) is selected to be greater than 7 and less than 99.

8. The peripheral pump as claimed in claim 7, wherein the ratio of the average diameter of the ring (5) of blades (6) to the radius of the delivery chambers (11, 12) is selected to be greater than 15 and less than 30.

9. The peripheral pump as claimed in claim 1, wherein edges of the blades (6) which project into the delivery chambers (11, 12) are rounded or have a bevel.

10. The peripheral pump as claimed in claim 9, wherein the radius or the bevel, as seen in the direction in which the rotor (2) moves, is arranged in a radially outer region on the edge of the front side of the blades (6) and in a radially inner region on the edge of the rear side.

11. The peripheral pump as claimed in claim 9, wherein the radius or the width of the bevel corresponds to at least 1/70 of the height of the blades (6).

12. The peripheral pump as claimed in claim 1, wherein the rotor (2), on its end sides (3, 4), has a plurality of recesses (15, 16) which lie opposite one another and in each case two mutually opposite recesses (15, 16) are connected to one another.

13. The peripheral pump as claimed in claim 12, wherein the recesses (15, 16), as seen from the blades (6), are arranged in the radially inner region of the rotor (2).

14. The peripheral pump as claimed in claim 12, wherein the recesses (15, 16) are of trough-like design.

15. The peripheral pump as claimed in claim 12, wherein the recesses (15, 16), in a tangential section through the rotor (2), are of pocket-shaped design.

16. The peripheral pump as claimed in claim 1, wherein the rotor (2) is produced from plastic using the injection-molding process.

* * * * *